US005249497A

United States Patent [19]

Niitsuma

[11] Patent Number: 5,249,497

[45] Date of Patent: Oct. 5, 1993

[54] KEYBORAD APPARATUS FOR ELECTRONIC MUSICAL INSTRUMENT

[75] Inventor: Shinji Niitsuma, Hamamatsu, Japan

[73] Assignee: Kabushiki Kaisha Kawai Gakki Seisakusho, Hamamastu, Japan

[21] Appl. No.: 867,338

[22] Filed: Apr. 13, 1992

[30] Foreign Application Priority Data

Apr. 24, 1991 [JP] Japan ..... 3-028854[U]

[51] Int. Cl.[5] ..... G10C 3/12; G10C 3/18

[52] U.S. Cl. ..... 84/247; 84/435; 84/DIG. 7

[58] Field of Search ..... 84/236-255, 84/433-437, 644, 670, 720, 745, DIG. 7, 439, 440; 200/5 A, 52 R

[56] References Cited

U.S. PATENT DOCUMENTS 3,927,594 12/1975 Morita ..... 84/237
4,723,471 2/1988 Sugimoto .
4,901,614 2/1990 Kumano et al. .
4,953,433 9/1990 Fandrich et al. ..... 84/239
4,993,305 2/1991 Franz et al. .
4,995,291 2/1991 Takahashi ..... 84/237

FOREIGN PATENT DOCUMENTS 63-155095 6/1988 Japan .

*Primary Examiner*—Stanley J. Witkowski
*Attorney, Agent, or Firm*—Armstrong, Westerman, Hattori, McLeland & Naughton

[57] ABSTRACT

A keyboard apparatus for an electronic musical instrument has a jack which is movable and rotatable by a force to be transmitted from a key, and a hammer which is rotatable by a force to be transmitted from the jack. The jack is rotatably engaged by a fulcrum which is provided in the key. The jack is urged to its original position by a spring. The key has a return load applying portion which abuts the hammer when the hammer rotated by the jack returns to its original position.

13 Claims, 3 Drawing Sheets

KEYBORAD APPARATUS FOR ELECTRONIC MUSICAL INSTRUMENT

BACKGROUND OF THE INVENTION

This invention relates to a keyboard apparatus for an electronic musical instrument such as an electronic piano.

As shown in FIG. 6, there is conventionally known a keyboard apparatus for an electronic musical instrument, comprising a key "a" which is provided so as to be rotatable about a fulcrum b and a hammer d which is supported on this key "a" so as to be rotatable about a fulcrum c. This hammer d is provided for the purpose of obtaining such a feeling of touching the key as in an acoustic piano. It has a predetermined weight and its center of gravity lies in the right-hand side in the figure.

When the key "a" is depressed, the hammer d rotates via a supporting member e. When the key "a" is released from depression, the hammer d and the key "a" are returned to their original positions by the weight of the hammer d.

In the above-mentioned conventional apparatus, it is possible to obtain the feeling of touching the key as in the acoustic piano only when the key is depressed with a force which is stronger than a predetermined one. When the key is depressed very gently or weakly, as shown in FIG. 7, a load greater than before begins to be applied from the point O and its value reaches a maximum at point P. It is impossible to obtain the feeling of touching the key as in the acoustic piano in which, when the key is further depressed, the load is released at a stretch (by means of a mechanism called a let-off mechanism).

OBJECT AND SUMMARY OF THE INVENTION

It is an object of this invention to provide a keyboard apparatus for an electronic musical instrument in which a feeling of touching a key like in an acoustic piano can be obtained at the time when a player weakly as well as strongly depresses a key and in which a performance or efficiency in depressing a key in rapid succession is good.

In order to attain the above-mentioned object, this invention is a keyboard apparatus for an electronic musical instrument, the apparatus comprising a jack which is movable and rotatable by a force to be transmitted from a key, and a hammer which is rotatable by a force to be transmitted from the jack, wherein the jack is rotatably engaged by a fulcrum which is provided in the key, the jack being urged to its original position by a resilient means, and wherein the key has a return load applying portion which abuts the hammer when the hammer rotated by the jack returns to its original position.

When the key is depressed, the jack also moves downwards. With the downward movement of the jack, the hammer is caused to rotate. When the key is strongly depressed, the hammer has an inertia effect. Also when the key is weakly depressed, it exerts trough its deadweight a force which is opposite to the direction of key depression. When the key is depressed to a certain depth, the jack starts rotating by its abutment with a fixing member. Since, at this time, the jack receives a reacting force from the fixing member, a player who has so far been weakly depressing the key will temporarily have to depress the key with a larger force. When the key is further depressed, the jack will become out of engagement with the hammer and, consequently, the force due to the deadweight of the hammer will no longer be transmitted. Therefore, the player who was weakly depressing the key feels a release or lack of force at a stretch. The key then reaches a lower limit position. The hammer is also once rotated to one rotation limit position through its inertia and then starts rotating in the opposite direction due to its deadweight until it stops as a result of its abutment with the return load applying portion of the key that is being positioned in the lower limit position. The hammer thus always applies a return load or force to the key during the return movement of the key. Therefore, even in the rapid successive key depression from a half-returned key position, the player can depress the key without impairing the feeling of mass on his finger.

The key returns to its original position by a spring and by the application of the return load of the hammer. The hammer also returns to the other rotation limit position and the jack, too, returns to its original position due to the force of the elastic member to make themselves ready for the next key depression.

BRIEF DESCRIPTION OF THE DRAWINGS

The above and other objects and the attendant advantages of this invention will become readily apparent by reference to the following detailed description when considered in conjunction with the accompanying drawings wherein.

DETAILED DESCRIPTION OF PREFERRED EMBODIMENTS

Figure 1:
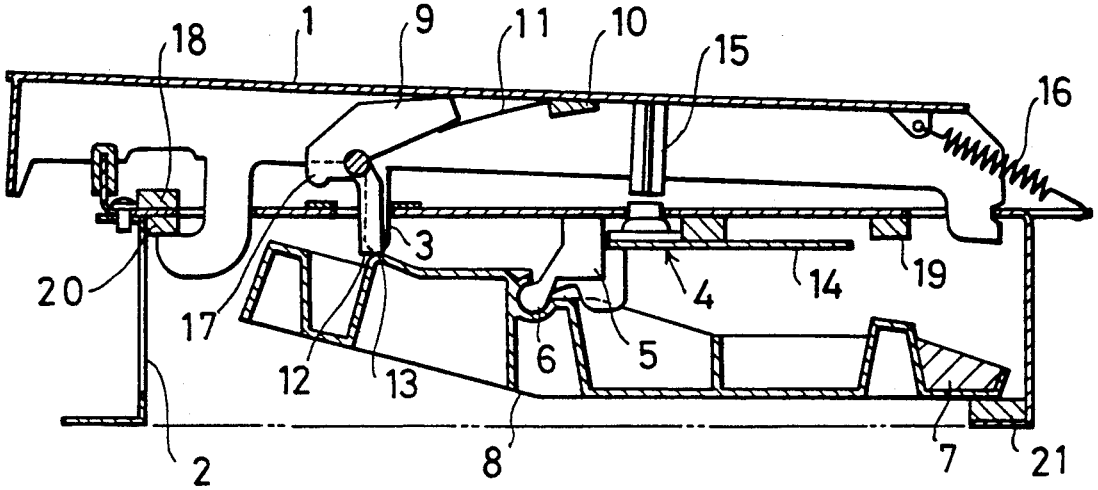
FIG. 1 is a side view, partly in section, of one embodiment of this invention apparatus in a condition that a key is not depressed.

Preferred embodiments of this invention are now explained with reference to the accompanying drawings.

FIGS. 1 through 4 show a first embodying example of this invention.

In FIGS. 1 through 4, numeral 1 denotes a (white) key which is rotatably supported on a keyboard frame 2 so as to be rotatable about a front end portion of the key. This key 1 is formed into a substantially box shape with the bottom end thereof left open. On at least one of both side walls of the key, there is formed a downwardly projecting return load applying portion 3 (as described in detail hereinafter). On the keyboard frame 2 there are fixed a switch 4 and a fulcrum member 5. On a fulcrum 6 of the fulcrum member 5 there is rotatably supported a hammer 8 which has attached thereto at its one end a weight 7. In an internal space of the key 1 there is rotatably supported a jack 9. The jack 9 is urged counterclockwise, as seen in the figure, by one end of a card-shaped plate spring 11 the other end of which is fixed to a plate spring receiving portion 10 provided on an inner upper wall of the key 1. A hammer-abutting portion 12 of the jack 9 is arranged to abut a jack-abutting portion 13 of the hammer 8. This hammer-abutting portion 12 of the jack 9 is formed slightly longer than the above-mentioned return load applying portion 3.

The above-mentioned switch 4 is supported on a switch board plate 14 and is arranged to be operated by the pressing of an actuator 15 which is provided on an inner upper wall of the key 1 when the key 1 rotates by a predetermined angle of rotation.

Figure 2:
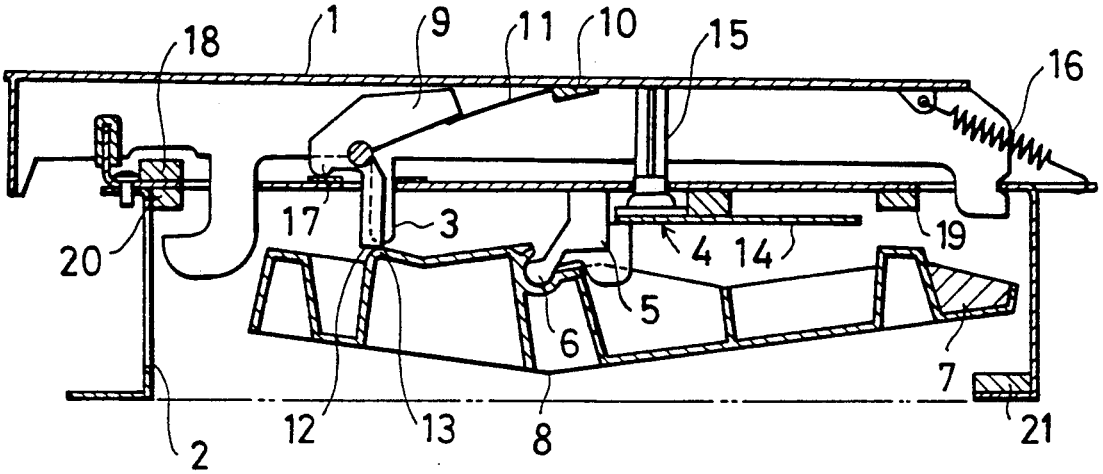
FIG. 2 is a side view, partly in section, of the above-mentioned embodiment in a condition that the key is depressed and a jack starts rotating.
Figure 3:
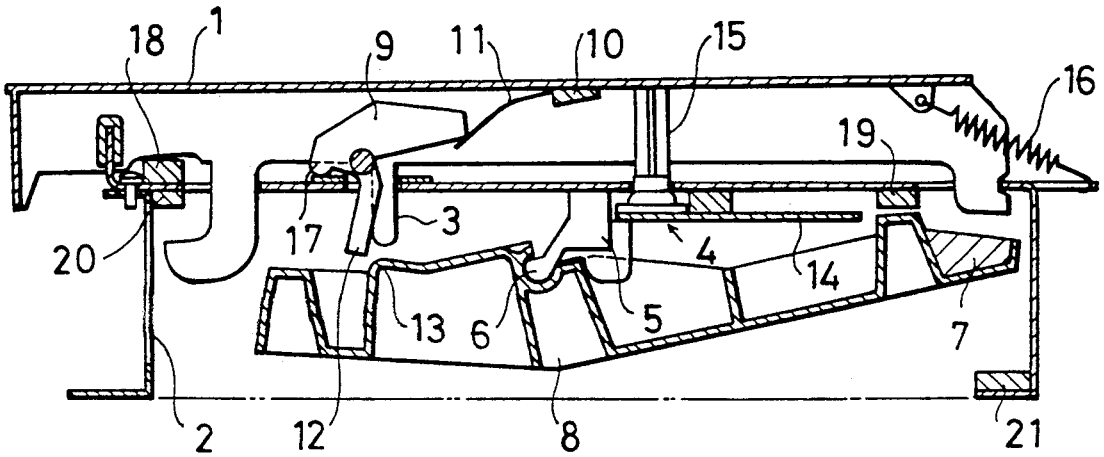
FIG. 3 is a side view, partly in section, of the above-mentioned embodiment in a condition that the key is depressed and the jack is out of engagement with a hammer.

The operation of this embodiment is now explained. When the key 1 is depressed, the key 1 starts rotating counterclockwise and, as a consequence, the jack 9 moves downwards. By the downward movement of the jack 9 the hammer-abutting portion 12 urges the jack-abutting portion 13 and, consequently, the hammer 8 starts rotating counterclockwise. At this time, a player receives a load of a coil spring 16 for load adjustment and the load of the hammer 8. When the key 1 is further depressed, a projecting portion 17 of the jack 9 comes into engagement with the keyboard frame 2 as shown in FIG. 2, and the jack 9 starts rotating. At this time, the player receives a reaction force from the keyboard frame 2 and the load of the plate spring 11 which is provided in the jack 9. When the key 1 is further depressed, the jack 9 comes out of engagement with the hammer 8 as shown in FIG. 3. However, the hammer 8 is brought, due to its inertia, into a condition of being instantly held in suspension in the space and, since the deadweight of the hammer 8 is not transmitted to the key 1, the player feels a sense of instant release or lack of force or of temporarily being free of load. Thereafter, the key 1 abuts a key lower limit stopper felt 18 to thereby terminate its rotation.

Figure 4:
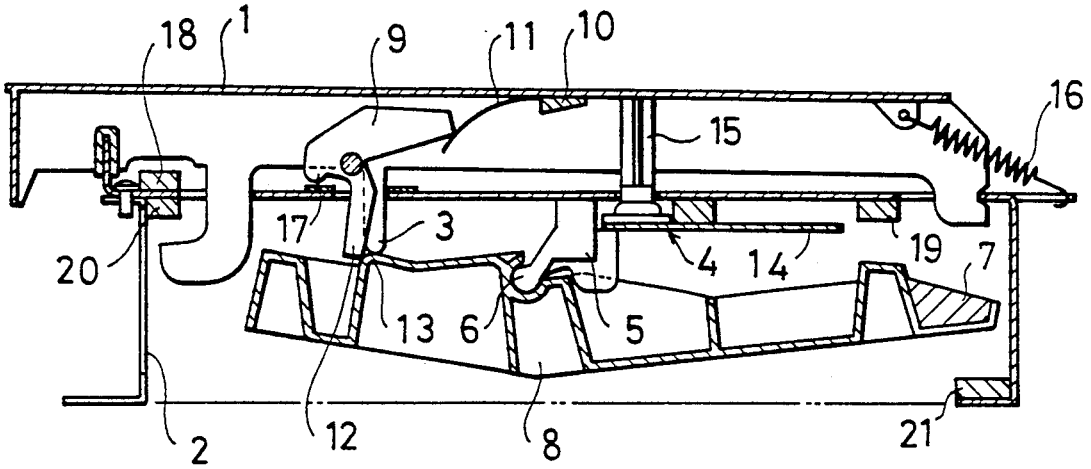
FIG. 4 is a side view, partly in section, of the above-mentioned embodiment right after the key has been released from depression.

After the hammer 8 has come into abutment with a hammer upper limit stopper felt 19, it starts rotating clockwise by its deadweight. As shown in FIG. 4, the jack-abutting portion 13 comes into abutment with the return load applying portion 3 of the key 1 to thereby stop the return movement of the hammer 8. Since this force of abutment of the jack-abutting portion 13 of the hammer 8 against the return load applying portion 3 is transmitted to the player through the key 1, it functions to cause the player to feel as if the hammer were in the returning movement of a hammer of the acoustic piano after having hit a string. At this time, the hammer-abutting portion 12 of the jack 9 cannot be returned onto the jack-abutting portion of the hammer 8.

When the key 1 is released from depression, the key 1 is returned to an initial position in which the key 1 abuts a key upper limit stopper felt 20 by a combined force of the deadweight of the hammer 8 and the elastic force of the coil spring 16 which is provided for load adjustment purpose. The hammer 8 also abuts a hammer lower limit stopper felt 21 and its rotation terminated. In this manner, the hammer-abutting portion 12 of the jack 9 is quickly returned by the elastic force of the plate spring 11 to the jack-abutting portion 13 of the hammer 8.

Since the load of the hammer 8 is transmitted to the key 1 through the load applying portion 3 by the abutment of the jack-abutting portion 13 of the hammer 8 against the return load applying portion 3 of the depressed key 1, the key returns, at the time of releasing the key depression, in a condition in which the load of the hammer 8 is constantly applied to the return load applying portion 3. Therefore, a feeling of mass is applied to a finger which is in contact with the key 1. As a consequence, this feeling of mass can be applied even at the time of depressing the key again on the way of the key's return movement. It follows that the feeling of mass is not impaired even during playing by rapid successive key depression.

Figure 5:
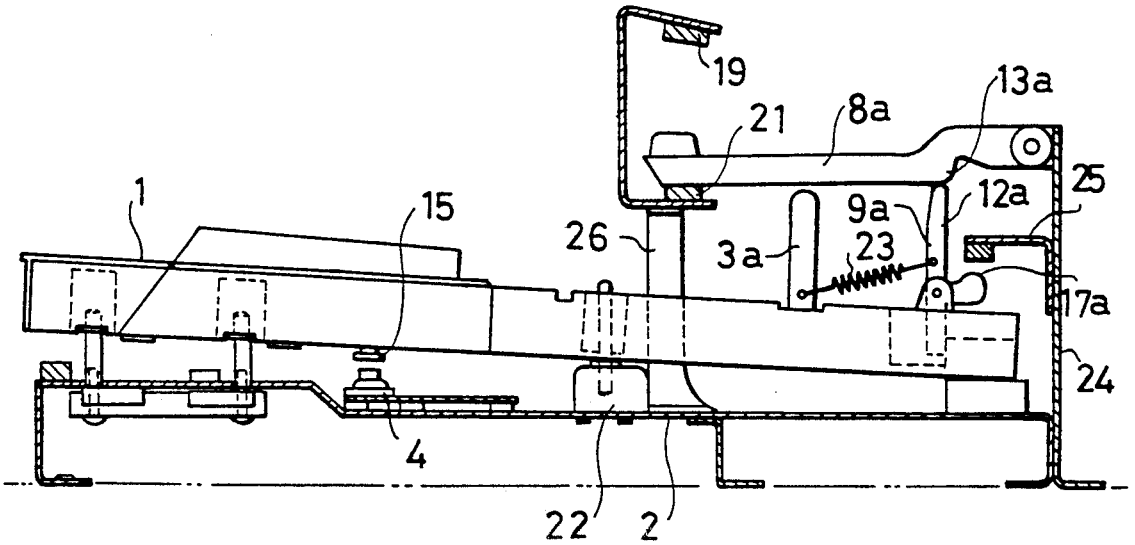
FIG. 5 is a side view of another embodiment of this invention apparatus in a condition that the key is released.
Figure 6:
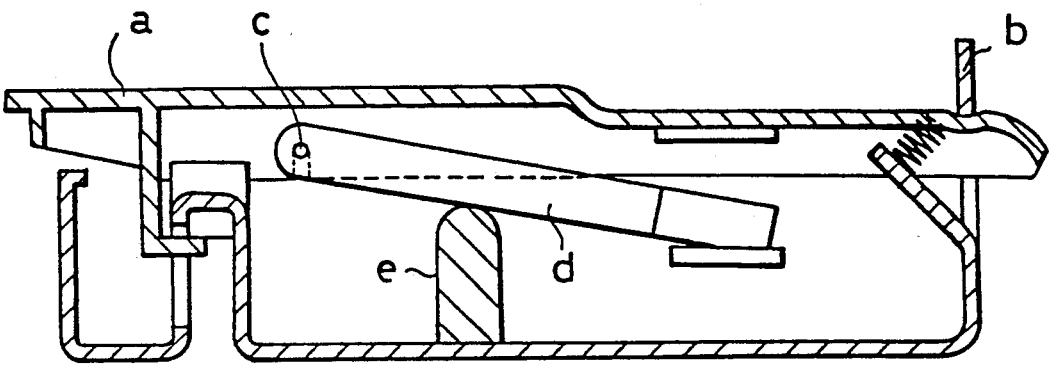
FIG. 6 PRIOR ART
FIG. 6 is a sectional view of a conventional keyboard apparatus of an electronic musical instrument.
Figure 7:
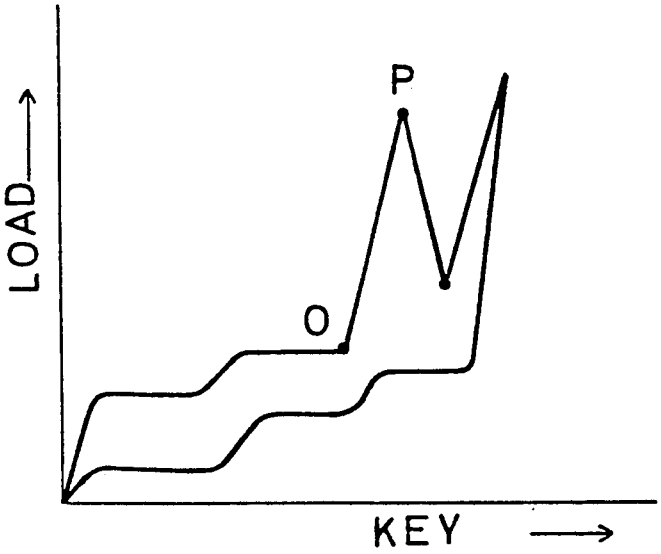
FIG. 7 PRIOR ART
FIG. 7 is a key stroke versus load characteristic curve of an acoustic piano.

FIG. 5 shows a second embodiment of this invention.

In this embodiment, a jack **9*a* is provided so as to be rotatable about a fulcrum which is provided at an upper front end portion of the key 1. A return load applying portion 3*a* of the key 1 is provided on an upper end of the key 1 away from the jack 9*a* towards a fulcrum 22 of the key 1. Between this return load applying member 3*a* and the jack 9*a*, there is extended a coil spring 23 such that the jack 9*a* is positioned in an initial position in which a hammer-abutting portion 12*a* of the jack 9*a* abuts a jack-abutting portion 13*a* of the hammer 8*a*. The hammer 8*a* is rotatably engaged with a rising piece 24 which rises from the keyboard frame 2. On this rising piece 24 there is also provided a rotating piece 25 against which a projecting portion 17*a* of the jack 9*a* comes into abutment to thereby rotate the jack 9*a*. The hammer upper limit stopper felt 19 and the hammer lower limit stopper felt 21 are fixed to a supporting member 26 which rises from the keyboard frame 2**.

The operation of the second embodiment is substantially the same as that of the first embodiment.

Since this invention has the above-mentioned construction, the player of this keyboard apparatus can obtain a feeling of touching a key like in an acoustic piano at the time when the player weakly as well as strongly depresses the key, and also can obtain the feeling of mass of the key by the abutment of the hammer with the return load applying portion also at the time of the key's returning when the key depression is released.

It is readily apparent that the above-mentioned keyboard apparatus for an electronic musical instrument has the advantage of wide commercial utility. It should be understood that the specific form of the invention hereinabove described is intended to be representative only, as certain modifications within the scope of these teachings will be apparent to those skilled in the art.

Accordingly, reference should be made to the following claim in determining the full scope of the invention.

What is claimed is:

1. A keyboard apparatus for an electronic musical instrument, said apparatus comprising a jack which is movable and rotatable by a force to be transmitted from a key, and a hammer which is rotatable by a force to be transmitted from said movable and rotatable jack, wherein said jack is rotatably engaged by a fulcrum which is provided in said key, said jack being urged to its original position by a resilient means for urging said jack towards its original position, and wherein said key has a return load applying portion which abuts said hammer after said hammer has been rotated by said jack and returns to its original position.

2. A keyboard apparatus according to claim 1, wherein said jack is rotated when a projecting portion of said jack comes into abutment with a keyboard frame, whereby said jack is released from engagement with said hammer.

3. A keyboard apparatus according to claim 1, wherein said hammer is rotatably supported by a fulcrum member which extends from a keyboard frame, and wherein said hammer has a weight on one end thereof and a jack-abutting portion near the other end thereof, said jack-abutting portion being selectively engaged with a hammer-abutting portion which extends from said jack and said return load applying portion which extends from said key.

4. A keyboard apparatus according to claim 1, wherein said key is rotatably supported on a keyboard frame at a front end portion of said key.

5. A keyboard apparatus according to claim 1, wherein said key is rotatably supported on a keyboard frame at an intermediate portion of said key.

6. A keyboard apparatus according to claim 4, wherein said hammer is positioned below said key.

7. A keyboard apparatus according to claim 5, wherein said hammer is positioned above said key.

8. A keyboard apparatus according to claim 6, wherein said resilient means is a plate spring extended to engage between said jack and said key.

9. A keyboard apparatus according to claim 7, wherein said resilient means is a coil spring extended to engage between said jack and said return load applying means.

10. A keyboard apparatus for an electronic musical instrument, said apparatus comprising a jack which is movable and rotatable by a force to be transmitted from a key, and a hammer which is rotatable by a force to be transmitted from said movable and rotatable jack, wherein said jack is rotatably engaged by a fulcrum which is provided in said key, said jack being urged to its original position by a resilient means for urging said jack towards its original position, and wherein said key has a return load applying portion extending outwardly from a side of said key and fixedly attached to said key and which abuts said hammer after said hammer has been rotated by said jack and returns to its original position.

11. A keyboard apparatus according to claim 10, wherein said force transmitted from said jack to said hammer is transmitted at an abutting portion of the hammer, said abutting portion of said hammer also being the portion of said hammer which abuts said return load applying portion.

12. A keyboard apparatus according to claim 11, wherein said abutting portion is a lower generally horizontal surface of said hammer.

13. A keyboard apparatus according to claim 11, wherein said abutting portion is an upper generally horizontal surface of said hammer.

* * * * *